United States Patent [19]

Masuda et al.

[11] Patent Number: 4,847,652

[45] Date of Patent: Jul. 11, 1989

[54] IMAGE TRANSFER DEVICE

[75] Inventors: Zitsuo Masuda, Nara; Hiroshi Kinashi, Kyoto; Yoshiharu Tsujimoto, Osaka; Masashi Hirai, Nara, all of Japan

[73] Assignee: Sharp Kabushiki Kaisha, Osaka, Japan

[21] Appl. No.: 273,626

[22] Filed: Nov. 17, 1988

Related U.S. Application Data

[63] Continuation of Ser. No. 94,510, Sep. 9, 1987, abandoned.

[30] Foreign Application Priority Data

Sep. 19, 1986 [JP] Japan ..... 61-222885
Sep. 19, 1986 [JP] Japan ..... 61-222886

[51] Int. Cl.[4] ..... G03G 15/16
[52] U.S. Cl. ..... 355/274; 355/309
[58] Field of Search ..... 355/3 TR, 14 TR, 3 CH, 355/3 SH; 250/234–236; 361/225, 229

[56] References Cited

U.S. PATENT DOCUMENTS 3,850,519 11/1974 Weikel, Jr. ..... 355/3 TR
4,174,170 11/1979 Yamamoto et al. ..... 355/3 TR
4,544,262 10/1985 Kanemitsu et al. ..... 355/3 TR

FOREIGN PATENT DOCUMENTS 58-209766 12/1983 Japan ..... 355/3 TR
58-221863 12/1983 Japan ..... 355/3 SH
59-218470 12/1984 Japan ..... 355/3 TR

*Primary Examiner*—Fred L. Braun
*Assistant Examiner*—J. Pendegrass
*Attorney, Agent, or Firm*—Flehr, Hohbach, Test, Albritton & Herbert

[57] ABSTRACT

An image transfer device has a screening plate attached to and protruding from a paper guide so as to partially block the corona ion current from its transfer charger such that only the forward portion of an incoming transfer paper sheet already in contact with the surface of a photosensitive drum is exposed to the current. An elastic guide plate separated from the drum surface by only about 1 mm serves to allow transfer paper sheet of different stiffness to come into contact with the drum surfaces at a predetermined position.

4 Claims, 3 Drawing Sheets

IMAGE TRANSFER DEVICE

This is a continuation of application Ser. No. 094,510, filed Sept. 9, 1987, abandoned.

BACKGROUND OF THE INVENTION

This invention relates to an image transfer device for an electrophotographic copier and the like for transferring toner from the surface of its photosensitive drum onto a sheet of transfer paper.

In an electrophotographic copier and the like, an electrostatic latent image is typically formed on the surface of a photosensitive drum and after electrically charged toner is electrostatically attached to this latent image, the resultant toner image is electrostatically transferred onto a transfer paper sheet by a corona ion current such that a toner image is finally formed on the front surface of this transfer sheet. A conventional image transfer device for carrying out the last of the steps above, that is, the step of transferring a toner image onto a transfer sheet, includes a charger box 2' disposed opposite to the photosensitive drum 1' as shown in FIG. 5 with a charger line 3' stretched inside the charger box 2'. A high voltage is adapted to be applied to this line 3' to produce a corona ion current. Numeral 4' indicates a paper guide for directing a transfer paper sheet 10' glidingly thereover onto the surface of the photosensitive drum 1' where the back surface of the transfer sheet 10' becomes charged by the corona ion current as explained above and toner is transferred from the drum surface to the front surface of the sheet 10'.

When an image transfer device of this type is used as explained above, the transfer of toner should take place ideally only after the sheet 10' comes into contact with the surface of the photosensitive drum 1' because this will make it certain that the toner image formed on the drum surface is accurately and reliably transferred onto the transfer paper sheet 10'. With a conventional image transfer device, however, the back surface of an incoming sheet 10' becomes charged as shown in FIG. 5 before the sheet 10' comes into contact with the surface of the drum 1'. A Coulomb force is thereby generated between such prematurely charged parts of the sheet 10' and toner particles on the surface of the drum 1', causing the toner particles to fly onto such parts of the sheet 10' and adversely affecting the quality of the image formed on the sheet.

If the incoming transfer sheet 10' is very thin, or tends to bend easily, the position at which it comes into contact with the surface of the drum 1' becomes unpredictable especially in cases where the separation is relatively large between the paper guide 4' and the surface of the drum 1'. In a situation like this, even the degree to which toner particles may be expected to scatter is unpredictable.

SUMMARY OF THE INVENTION

It is therefore a general object of the present invention in view of the above to provide an image transfer device characterized by an improved image quality.

It is another object of the present invention to provide an image transfer device capable of preventing toner from scattering onto the image formed on the incoming transfer paper sheet.

It is still another object of the present invention to provide an image transfer device capable of preventing the incoming transfer paper sheet from being charged before it comes into contact with the surface of the photosensitive drum.

It is a further object of the present invention to provide an image transfer device characterized as above independently of the thickness and stiffness of the incoming transfer paper sheet.

In view of the above objects, an image transfer device according to one embodiment of the present invention is characterized as having a screening plate of an insulating material on the paper guide such that the charging by the transfer charger is limited to areas in front of the point at which the transfer paper sheet comes into contact with the photosensitive drum with respect to the direction of rotation thereof. With an image transfer device thus structured, the part of the incoming transfer paper sheet which is not in contact with the photosensitive drum yet is prevented from becoming charged and toner is not scattered onto this area. Since the screening plate is made of an insulating material, furthermore, there is no danger of a leak current between the charger line and the screening plate, or of an excessive current flowing therebetween which may cause lowering of the current between the charger line and the screening plate and hence make it difficult to properly charge the transfer paper sheet. According to another embodiment of the present invention, a guide plate which is made of an elastic material is attached to the paper guide and is separated from the surface of the photosensitive drum approximately by 1 mm. With an image transfer device thus structured, the incoming transfer sheet is supported by the paper guide until it is nearly ready to come into contact with the surface of the photosensitive drum. Thus, even if the sheet is thin and tends to bend easily, the position of its contact with the surface of the photosensitive drum becomes predictable, and hence an image of good quality can be expected reliably. Moreover, since the guide plate is made of an elastic material, it can bend if the incoming transfer paper sheet is relatively thick or stiff, allowing the sheet to come into contact with the photosensitive drum at the same contact position.

BRIEF DESCRIPTION OF THE DRAWINGS

The accompanying drawings, which are incorporated in and form a part of the specification, illustrate embodiments of the present invention and, together with the description serve to explain the principles of the invention. In the drawings.

DETAILED DESCRIPTION OF THE INVENTION

Figure 1:
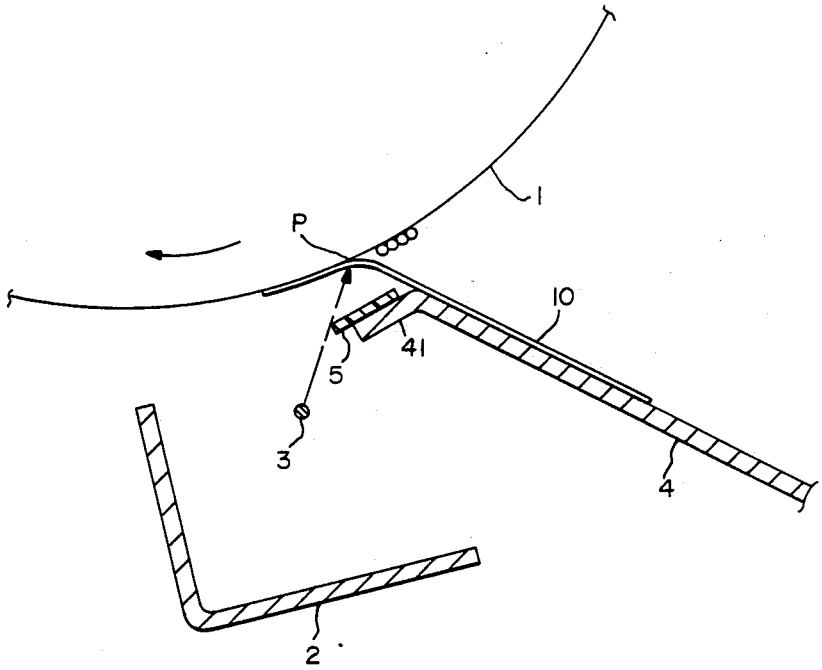
FIG. 1 is a schematic sectional view of an image transfer device embodying the present invention to show its structure.

In FIG. 1, numeral 1 indicates a photosensitive drum of a type well known in electrophotography adapted to rotate in the direction shown by an arrow. An image transfer device according to one embodiment of the present invention includes a charger box 2 disposed opposite to the photosensitive drum 1 and a paper guide 4, both made of an electrically conductive material such as a metal. The charger box 2 has an L-shaped cross section, opening both on the side opposite to the photosensitive drum 1 and on the side opposite to the paper guide 4, and includes a charger line 3 stretched in the direction parallel to the axis of rotation of the photosensitive drum 1. A high voltage is adapted to be applied to this charger line 3 to generate a corona ion current.

Figure 5:
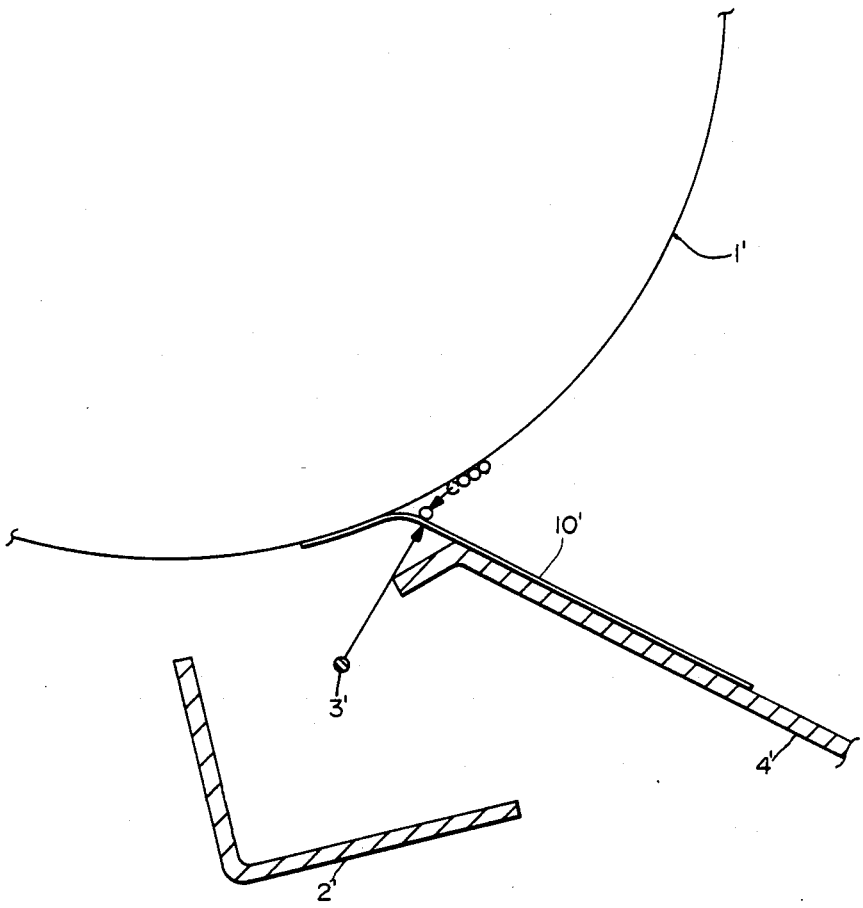
(PRIOR ART) FIG.—5
FIG. 5 is a schematic sectional view of a prior art image transfer device for showing its structure.

The paper guide 4 has a slightly bent edge section 41 proximal to the photosensitive drum 1 so as to be approximately parallel to the surface thereof. Numeral 10 indicates a transfer paper sheet which is guided by the paper guide 4 to come into contact with the photosensitive drum 1. The position on the surface of the photosensitive drum 1 where the sheet 10 is intended to come into contact therewith is indicated by P. The edge section 41 of the paper guide 4 is provided with a screening plate 5 on the side proximal to the photosensitive drum 1. The screening plate 5 is made of an insulating material such as polyethylene terephthalate (PET) and is disposed such that the corona ion current from the charger line 3 charges the portion of the sheet 10 in front of the intended contact position P with reference to the rotation of the drum 1 (to the left of P in FIG. 1) but is prevented from reaching the back portion of the sheet 10 behind P (to the right of P in FIG. 1). As shown clearly by a comparison between FIGS. 1 and 5, toner particles on the portion of the drum surface not in contact with the transfer paper sheet 10 are not attracted by any Coulomb force and hence do not fly to reach the portion of the sheet 10 behind the contact position P. Since the screening plate 5 is disposed on the side of the edge section 41 of the paper guide 4 proximal to the photosensitive drum 1 as explained above, furthermore, its presence does not excessively increase the impedance of the charger line 3.

Another image transfer device embodying the present invention is explained next by way of FIG. 2 wherein components which are similar or identical to those shown in FIG. 1 and explained above in connection therewith are indicated by the same numerals. This image transfer device is characterized by a guide plate 50 attached onto the surface of the paper guide 4 inclusive of its edge section 41 opposite to the photosensitive drum 1. This guide plate 50 is made of an insulative elastic material such as PET and includes not only an edge section 51 which is attached to the edge section 41 of the paper guide 4 and hence is approximately parallel to the surface of the photosensitive drum 1 but also a small protruding piece 52 branching off from the edge section 51 and pointing approximately in the direction of the contact position P. The distance separating the end of the protruding piece 52 and the surface of the photosensitive drum 1 depends generally upon the angles of the paper guide 4 and the guide plate 50 (that is, the protruding piece 52) with the photosensitive drum 1 but is approximately 1 mm.

Figure 2:
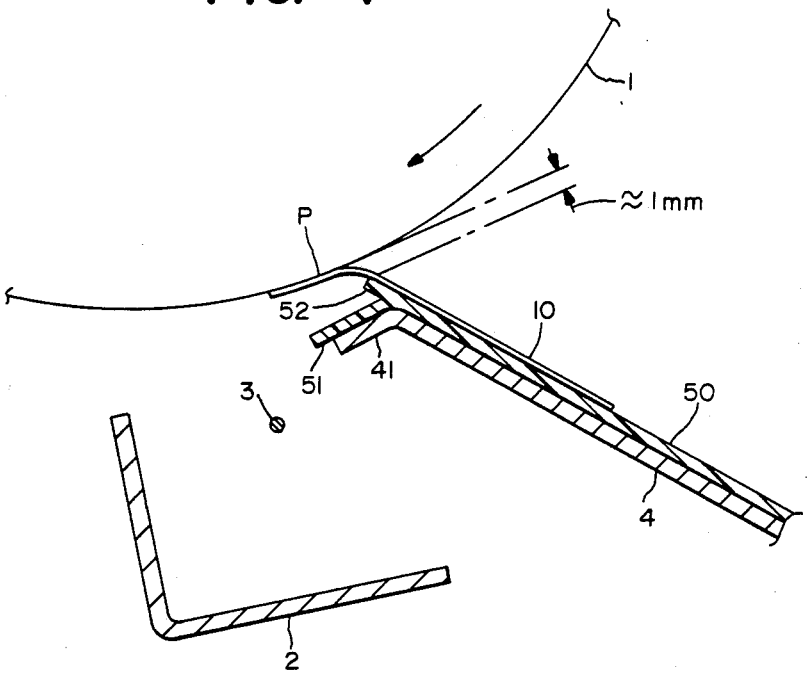
FIG. 2 is a schematic sectional view of another image transfer device embodying the present invention to show its structure.
Figure 3:
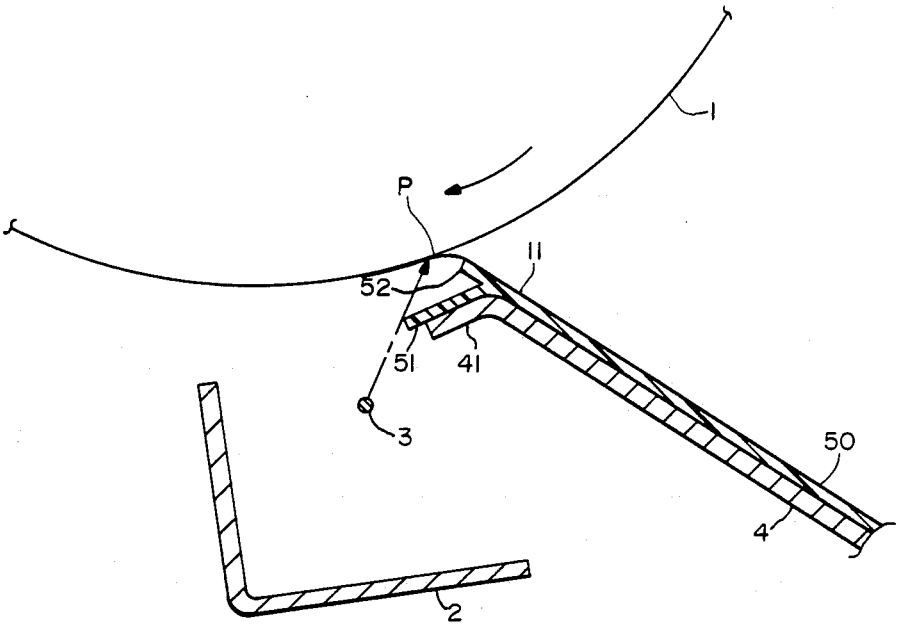
FIG. 3 is a schematic sectional view of the image transfer device of FIG. 2 with a relatively thin or flexible transfer paper sheet.

FIG. 3 shows the image transfer device of FIG. 2 when a relatively thin and/or flexible transfer paper sheet 11 is transported to the photosensitive drum 1, gliding on the surface of the guide plate 50. A thin or flexible transfer paper sheet 11 does not apply a substantial force on the protruding piece 52 and is led thereby to its end point which, as explained above, is separated from the surface of the drum 1 by only about 1 mm. Thereafter, it comes into contact with the rotating drum 1 at the contact position P. Since the separating distance of 1 mm is sufficiently small, even a very thin transfer paper sheet reaches the drum surface substantially at the intended contact position P.

Figure 4:
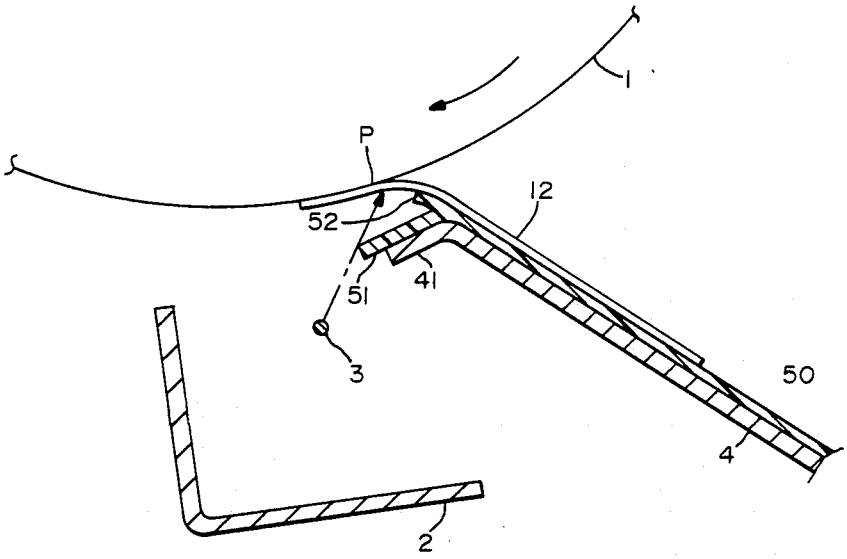
FIG. 4 is a schematic sectional view of the image transfer device of FIG. 2 with a relatively thick or stiff transfer paper sheet.

FIG. 4 shows the image transfer device of FIG. 2 when a relatively thick and/or stiff transfer paper sheet 12 is transported to the photosensitive drum 1, gliding similarly on the surface of the guide plate 50. After this sheet 12 is guided by the protruding piece 52 to come into contact with the surface of the photosensitive drum 1, it is pulled forward by the clockwise rotation of the drum 1 and if the sheet 12 is sufficiently thick or stiff, it presses and bends the protruding piece 52 downward in coming into contact with the drum 1 at the contact position P. In summary, the incoming transfer sheet, be it relatively flexible or stiff, can be caused to come into contact with the photosensitive drum 1 at the predetermined contact position P.

The foregoing description of preferred embodiments of the invention has been presented for purposes of illustration and description. It is not intended to be exhaustive or to limit the invention to the precise form disclosed, and many modification and variations are possible in light of the above teaching. For example, the edge section 51 need not be formed unistructurally with the guide plate 50. Any such modifications and variations that may be apparent to a person skilled in the art are intended to be included within the scope of this invention.

We claim:

1. In an image transfer device comprising a photosensitive drum with a contact position defined thereon and a transfer charger for providing a corona ion current over an area on said drum surface, a transfer paper sheet being adapted to be transported to and to come into contact with said drum surface at said contact position, the improvement wherein said image transfer device further comprises current limiting means for limiting said corona ion current to the forward portion of said area with respect to said contact position, said current limiting means including a paper guide plate extending generally towards said contact position and having a front edge section substantially parallel to said drum surface, and a screening plate attached to a surface of said paper guide plate proximal to said drum surface for directing said transfer paper sheet to said drum surface, said screening plate extending protrudingly beyond said front edge section of said paper guide plate so as to block a backward portion of said corona ion current, said screening plate having a bendable protruding piece which branches off said screening plate, normally extending substantially towards said contact position, said protruding piece being elastically bendable such that both lighter and heavier transfer sheets can be transported over said screening plate to said contact position.

2. The image transfer device of claim 1 wherein said screening plate comprises an insulating material.

3. The image transfer device of claim 1 wherein said screening plate comprises polyethylene terephthalate.

4. The image transfer device of claim 1 wherein said protruding piece is separated from said drum surface normally by about 1 mm.

* * * * *